US008079727B2

(12) United States Patent
Liang

(10) Patent No.: US 8,079,727 B2
(45) Date of Patent: Dec. 20, 2011

(54) RECESSED LAMP SUPPORT STRUCTURE

(75) Inventor: Jim-Hung Liang, Taipei (TW)

(73) Assignee: Skynet Electronic Co., Ltd., Taipei (TW)

( * ) Notice: Subject to any disclaimer, the term of this patent is extended or adjusted under 35 U.S.C. 154(b) by 30 days.

(21) Appl. No.: 12/659,861

(22) Filed: Mar. 24, 2010

(65) Prior Publication Data

US 2011/0235342 A1 Sep. 29, 2011

(51) Int. Cl.
*F21S 8/00* (2006.01)

(52) U.S. Cl. ..... 362/147; 362/148; 362/217.12; 362/365; 362/368

(58) Field of Classification Search ..... 362/217.12, 362/217.13, 217.16, 365, 368, 401, 402, 362/147, 148
See application file for complete search history.

(56) References Cited

U.S. PATENT DOCUMENTS 3,037,110 A * 5/1962 Williams ..... 362/147
6,000,818 A * 12/1999 Caluori ..... 362/365
6,152,573 A * 11/2000 Mitchell ..... 362/223
6,439,741 B1 * 8/2002 Diaz et al. ..... 362/396
7,476,010 B2 * 1/2009 Johnson ..... 362/373
7,954,974 B2 * 6/2011 Johnson ..... 362/147
2007/0258233 A1 * 11/2007 Gray ..... 362/148
2010/0014282 A1 * 1/2010 Danesh ..... 362/147
2010/0165607 A1 * 7/2010 Russo et al. ..... 362/147

* cited by examiner

*Primary Examiner* — Anabel Ton
(74) *Attorney, Agent, or Firm* — Bacon & Thomas, PLLC

(57) ABSTRACT

The present invention is to provide a recessed lamp support structure, which includes a lamp holder and at least two resilient plates. Each of the resilient plates has a front section fixedly connected to a sidewall of the lamp holder in a manner symmetrical to the others and a rear section extended away from the sidewall of the lamp holder, wherein the rear section has a roughened surface at a position away from the sidewall of the lamp holder. When the lamp holder is installed in a receiving hole of a ceiling, the roughened surfaces are able to press tightly and symmetrically against an inner periphery of the receiving hole due to the stress of the resilient plates, thereby securely positioning the lamp holder in the receiving hole while an annular frame of the lamp holder covers a gap between the receiving hole and the sidewall of the lamp holder.

6 Claims, 8 Drawing Sheets

RECESSED LAMP SUPPORT STRUCTURE

FIELD OF THE INVENTION

The present invention relates to a lamp support structure, more particularly to a recessed lamp support structure, which includes a lamp holder and at least two resilient plates each having a front section fixedly connected to a sidewall of the lamp holder in a symmetrical manner and a rear section extended away from the sidewall of the lamp holder. When the recessed lamp support structure is installed in a receiving hole of a ceiling, roughened surfaces of the rear sections away from the sidewall of the lamp holder are able to press tightly and symmetrically against an inner periphery of the receiving hole due to the stress of the resilient plates, thereby securely positioning the recessed lamp support structure in the receiving hole by friction between the roughened surfaces and the inner periphery of the receiving hole while an annular frame of the lamp holder covers a gap between the receiving hole and the sidewall of the lamp holder.

BACKGROUND OF THE INVENTION

Referring to FIG. 1, a conventional recessed lamp (also known as "downlight") structure 10 is shown as embedded in a ceiling 14 and includes a lamp holder 11 and a light bulb 12, wherein the lamp holder 11 has a bottom portion formed with an opening 111, and the light bulb 12 is installed in a receiving space 112 defined in the lamp holder 11. The bottom portion of the lamp holder 11 has a peripheral edge bent horizontally outward, thereby forming a circular annular frame 113 around the bottom portion of the lamp holder 11. In addition, the lamp holder 11 has a top portion formed with a sidewall, wherein the sidewall is symmetrically provided with two pivotal connectors 114, each connected with a torsion spring 13. Each torsion spring 13 has a first end passing through the corresponding pivot connector 114 and fixed to the inner side of the top portion of the lamp holder 11. Each torsion spring 13 further has a second end which, when no external force is applied thereto, is twisted away from the first end of the torsion spring 13 due to the stress of the torsion spring 13. Therefore, when it is desired to install the conventional recessed lamp structure 10 in a receiving hole 141 formed in the ceiling 14, the second end of each torsion spring 13 must be pushed toward the first end of the torsion spring 13 first. Then, the top portion of the lamp holder 11 is inserted into the receiving hole 141 of the ceiling 14. As soon as the push on the torsion springs 13 is released, the second ends of the torsion springs 13 are again twisted away from the corresponding first ends of the torsion springs 13 and press against a top side of the ceiling 14 due to the stress of the torsion springs 13, thereby providing the recessed lamp structure 10 with an upward supporting force. Thus, the recessed lamp structure 10 is positioned in the receiving hole 141 by the supporting force while the circular annular frame 113 covers the gap between the receiving hole 141 and the sidewall of the lamp holder 11.

Once the recessed lamp structure 10 is settled in the receiving hole 141, the second ends of the torsion springs 13 are twisted downward and press against the top side of the ceiling 14 due to the stress of the torsion springs 13. As a result, the ceiling 14 is clamped between the second ends of the torsion springs 13 and the circular annular frame 113. When it is desired to remove the recessed lamp structure 10 from the ceiling 14, the second ends of the torsion springs 13 must be pushed upward toward the corresponding first ends of the torsion springs 13, and the supporting force exerted on the recessed lamp structure 10 by the torsion springs 13 must be released, before the recessed lamp structure 10 can be pulled out of the receiving hole 141. However, as the torsion springs 13 are now shielded by the ceiling 14 and inaccessible to the user, the recessed lamp structure 10 cannot be efficiently removed. The user has to pull the portion of the recessed lamp structure 10 that is exposed outside the receiving hole 141 (i.e., the circular annular frame 113), thereby applying a downward force to the torsion springs 13. In response, the ceiling 14 applies a reaction force to the second ends of the torsion springs 13 and drives them upward. Thus, the supporting force acting on the recessed lamp structure 10 by the torsion springs 13 is removed, and the recessed lamp structure 10 is ready to be removed from the receiving hole 141. Nevertheless, the aforesaid operation tends to damage the overall structure of the receiving hole 141 of the ceiling 14 and hence produce a lot of wood chips and dust on the site. Moreover, immediately after the second ends of the torsion springs 13 leave the inner periphery of the receiving hole 141, the torsion springs 13 release the accumulated stress by twisting their second ends away from their first ends in a vigorous manner, and the vigorously twisting torsion springs 13 may pinch or even injure the user's fingers or palm. In short, the conventional recessed lamp structure 10 requires time-consuming and laborious installation and removal, tends to cause pinch injury to the user's fingers or palm during removal, and may result in irreparable damage to the receiving hole 141 formed in the ceiling 14. Consequently, it is prohibitively difficult to use the conventional recessed lamp structure 10 repeatedly in different places.

Referring to FIG. 2 for another conventional recessed lamp structure 60, the recessed lamp structure 60 includes a lamp holder 61, a fixing frame 62, and a light source element 63. The lamp holder 61 is laterally formed with a through hole 611 which allows the light source element 63 to be put into a receiving space 612 in the lamp holder 61 along a lateral direction. Additionally, the lamp holder 61 has a bottom portion with a peripheral edge bent horizontally outward such that a circular annular frame 613 is formed around the bottom portion of the lamp holder 61. The fixing frame 62 is fastened to a top portion of the lamp holder 61 by a screw 621. Besides, two bent engaging plates 64 are symmetrically provided at the two ends of the fixing frame 62. Each bent engaging plate 64 has two ends which are bent away from the lamp holder 61 and are symmetrically and protrudingly provided with a plurality of ribs 641. When it is desired to install the recessed lamp structure 60 in a receiving hole formed in a ceiling (not shown in the drawing but equivalent to the receiving hole 141 in the ceiling 14 as shown in FIG. 1), the top portion of the lamp holder 61 is directly inserted into the receiving hole of the ceiling such that the ribs 641 on the two ends of each bent engaging plate 64 engage with the inner periphery of the receiving hole. Thus, the recessed lamp structure 60 is positioned in the receiving hole by engagement between the bent engaging plates 64 and the receiving hole. Meanwhile, the gap between the receiving hole and the sidewall of the lamp holder 61 is covered by the circular annular frame 613.

However, a user trying to remove the recessed lamp structure 60 from the ceiling will face the same problem as with the recessed lamp structure 10 shown in FIG. 1. As the bent engaging plates 64 rely on the ribs 641 formed thereon to engage with the inner periphery of the receiving hole, the bent engaging plates 64 themselves are not very resilient, and the lack of resilience of the bent engaging plates 64 prevents efficient removal of the recessed lamp structure 60. Therefore, in order to remove the recessed lamp structure 60, the user must pull the portion of the recessed lamp structure 60 that is exposed outside the receiving hole (i.e., the circular annular frame 613), apply a downward force directly to the recessed lamp structure 60, and damage the inner periphery of the receiving hole so as to break the engagement between the bent engaging plates 64 and the inner periphery of the receiving hole. As a result, the receiving hole of the ceiling is structurally damaged and cannot be used to accommodate another recessed lamp. Besides, the foregoing operation also produces a huge amount of wood chips and dust that may inconvenience the user of the recessed lamp structure 60.

Furthermore, as the recessed lamp structure 60 is positioned in the receiving hole by engagement between the two bent ends of each bent engaging plate 64 and the inner periphery of the receiving hole, the shape of the circular annular frame 613 formed around the bottom portion of the recessed lamp structure 60 is limited by the configuration of the bent engaging plates 64 and must be circular. In other words, the circular annular frame 613 cannot be rectangular instead, or have a wavy perimeter, or take on other annular shapes. Now that the recessed lamp structure 60 can only be installed in a circular receiving hole but not a receiving hole of a rectangular or other shape, the field of application of the recessed lamp structure 60 is restricted.

Therefore, it has been an important subject in the related industry to develop a novel recessed lamp support structure that can overcome the aforementioned drawbacks of the conventional recessed lamp structures. It is desirable that the recessed lamp support structure can be securely positioned in a receiving hole by friction between the inner periphery of the receiving hole and a plurality of resilient plates that are provided on the recessed lamp support structure and configured to press tightly against the inner periphery of the receiving hole, thus enabling rapid and safe installation and removal of the recessed lamp support structure.

BRIEF SUMMARY OF THE INVENTION

In view of the aforesaid shortcomings of the prior art, the inventor of the present invention put years of practical experience into research and experimentation and finally succeeded in developing a recessed lamp support structure capable of rapid and safe installation and removal.

It is an object of the present invention to provide a recessed lamp support structure which includes a lamp holder and at least two resilient plates. The lamp holder has a bottom portion provided with an opening. A receiving space is defined in the lamp holder for accommodating a light-emitting element, such as a light-emitting diode (LED) light bulb, an incandescent light bulb, a fluorescent light bulb, or the like. The lamp holder has a peripheral edge which is adjacent to the opening and extends radially so as to form an annular frame around the bottom portion of the lamp holder, wherein the annular frame may have a rectangular shape, a circular shape, a wavy perimeter, or other annular configurations. Each resilient plate is made by bending a flexible metal plate so as to form a front section, a middle section, and a rear section. The front sections of the resilient plates are fixedly connected to a sidewall of the lamp holder in a symmetrical manner, wherein the fixed connection can be implemented by riveting or screwing. The middle section of each resilient plate extends toward the rim of the annular frame and has a tail end. A tangent line of the tail end of each middle section forms a first included angle with the sidewall of the lamp holder. Besides, the rear section of each resilient plate forms a second included angle with the tangent line of the tail end of the corresponding middle section. The magnitude of the first included angle and the length of the middle section of each resilient plate are so designed that the sidewall of the lamp holder is allowed to penetrate a receiving hole formed in a ceiling and be received on a top side of the ceiling such that the rear section of each resilient plate presses tightly against the inner periphery of the receiving hole while a top side of the annular frame presses against a bottom side of the ceiling. Moreover, the rear section of each resilient plate has an outer surface formed as a roughened surface having, for example, a serrated, granular, or undulated configuration. The magnitude of the second included angle and the length of the rear section of each resilient plate are so designed that the outer surface of the rear section of each resilient plate can press evenly and tightly against the inner periphery of the receiving hole, thereby generating a friction between the roughened surfaces and the inner periphery of the receiving hole. The friction can hold the weight of the recessed lamp support structure and securely position the recessed lamp support structure in the receiving hole. The recessed lamp support structure is installed in the receiving hole of the ceiling in the following manner. To begin with, a user can press the rear sections of the resilient plates against the resilient force of the resilient plates, thus bringing the front and rear sections of each resilient plate close to each other. Then, a top portion of the lamp holder is inserted into the receiving hole of the ceiling. Once the pressing on the resilient plates is released, the roughened surfaces of the rear sections of the resilient plates move away from the sidewall of the lamp holder and press tightly against the inner periphery of the receiving hole due to the stress of the resilient plates, thereby generating a horizontal tension between the inner periphery of the receiving hole and the sidewall of the lamp holder. Consequently, the recessed lamp support structure is securely positioned in the receiving hole by friction between the roughened surfaces and the inner periphery of the receiving hole while the annular frame covers the gap between the receiving hole and the sidewall of the lamp holder. The present invention uses no other fastening elements than a plurality of bent resilient plates on the sidewall of the lamp holder to enable rapid, easy, and safe installation/removal of the recessed lamp support structure into/from the receiving hole of the ceiling, thereby solving the problem of inconvenient installation/removal of the conventional recessed lamp structures.

BRIEF DESCRIPTION OF THE SEVERAL VIEWS OF THE DRAWINGS

The invention as well as a preferred mode of use, further objects, and advantages thereof will be best understood by referring to the following detailed description of illustrative embodiments in conjunction with the accompanying drawings, in which.

DETAILED DESCRIPTION OF THE INVENTION

Figure 1:
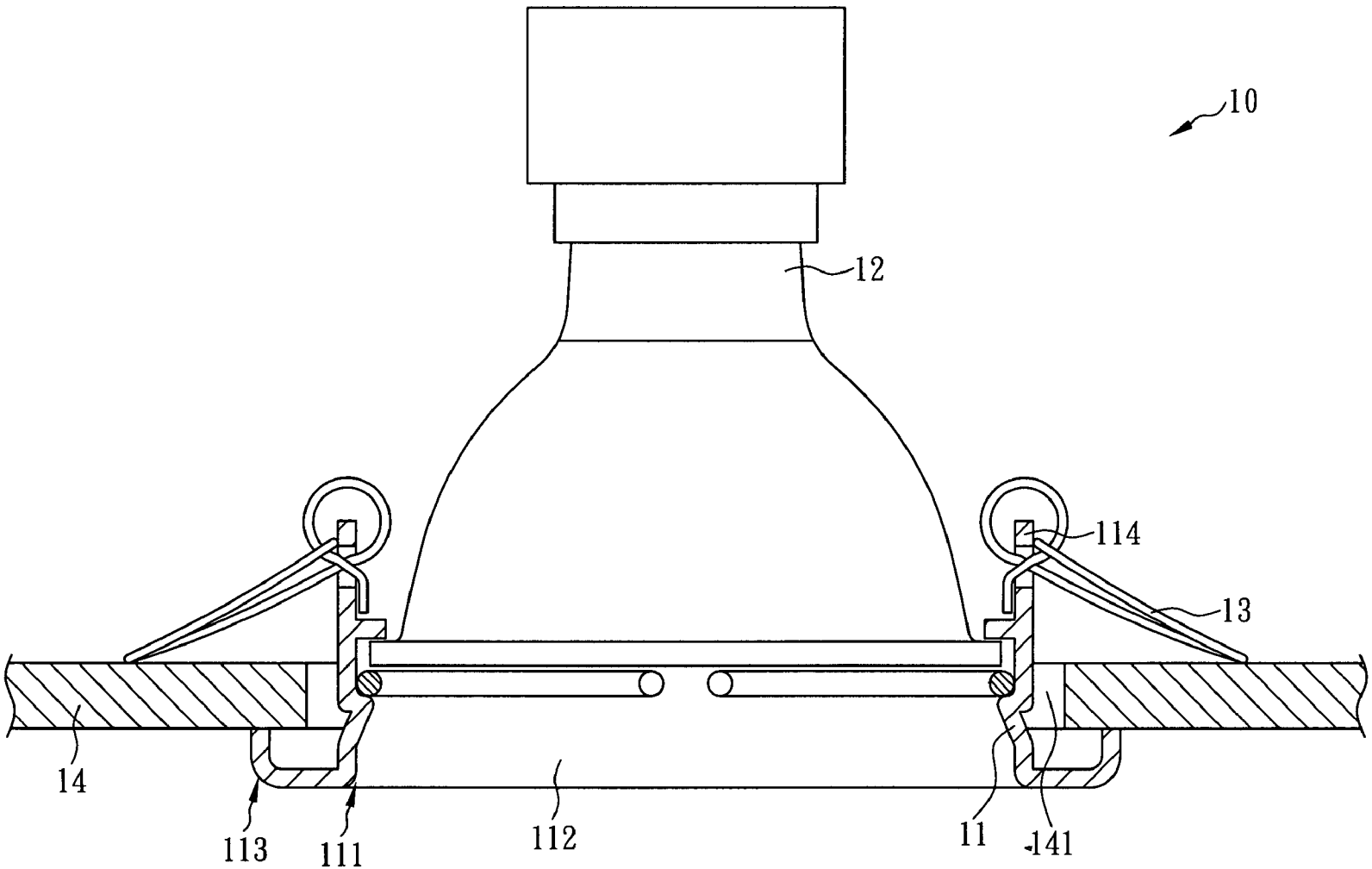
FIG. 1 (Prior Art)
FIG. 1 is a sectional view of a conventional recessed lamp structure.
Figure 2:
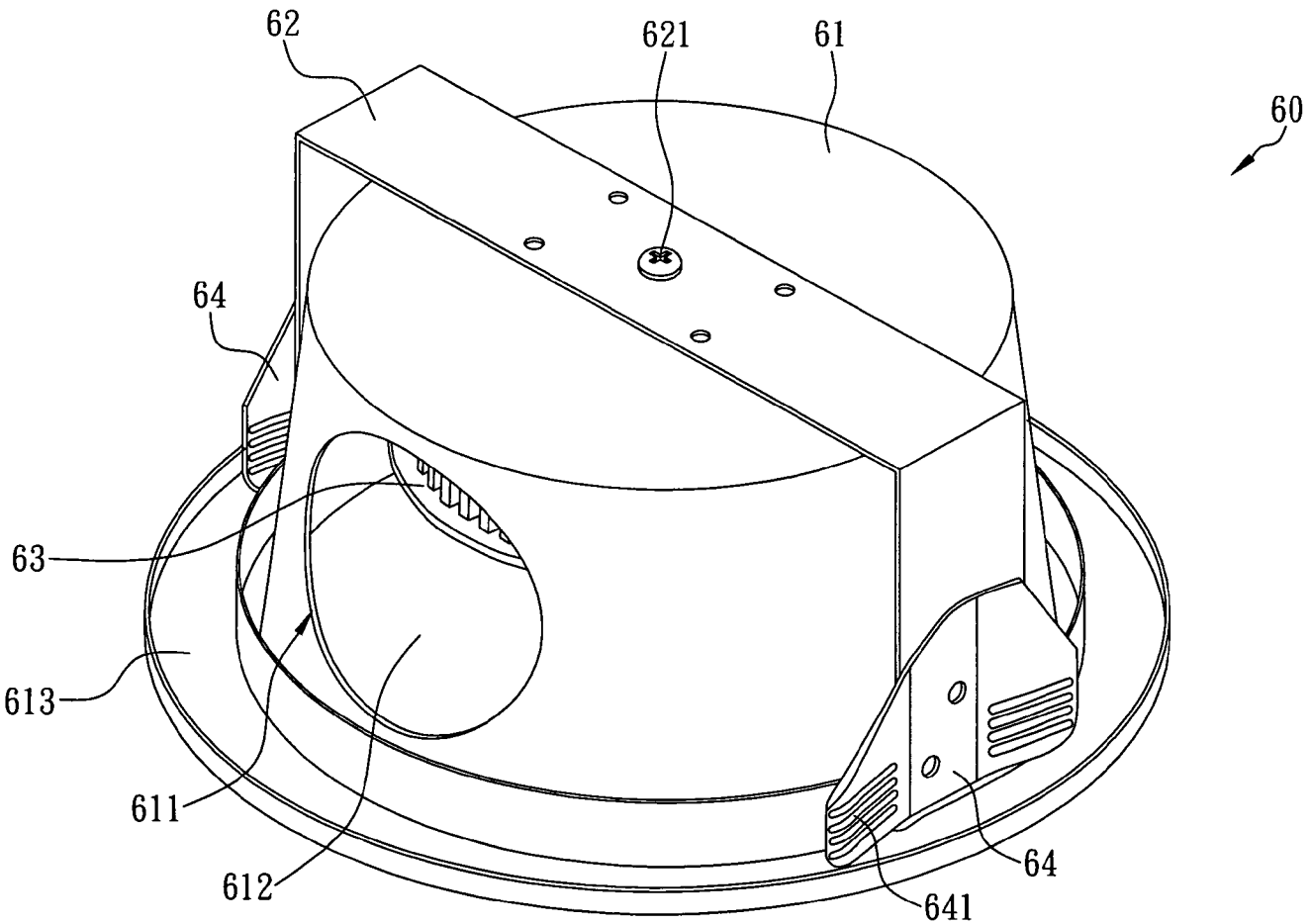
FIG. 2 (Prior Art)
FIG. 2 is a perspective view of another conventional recessed lamp structure.
Figure 3:
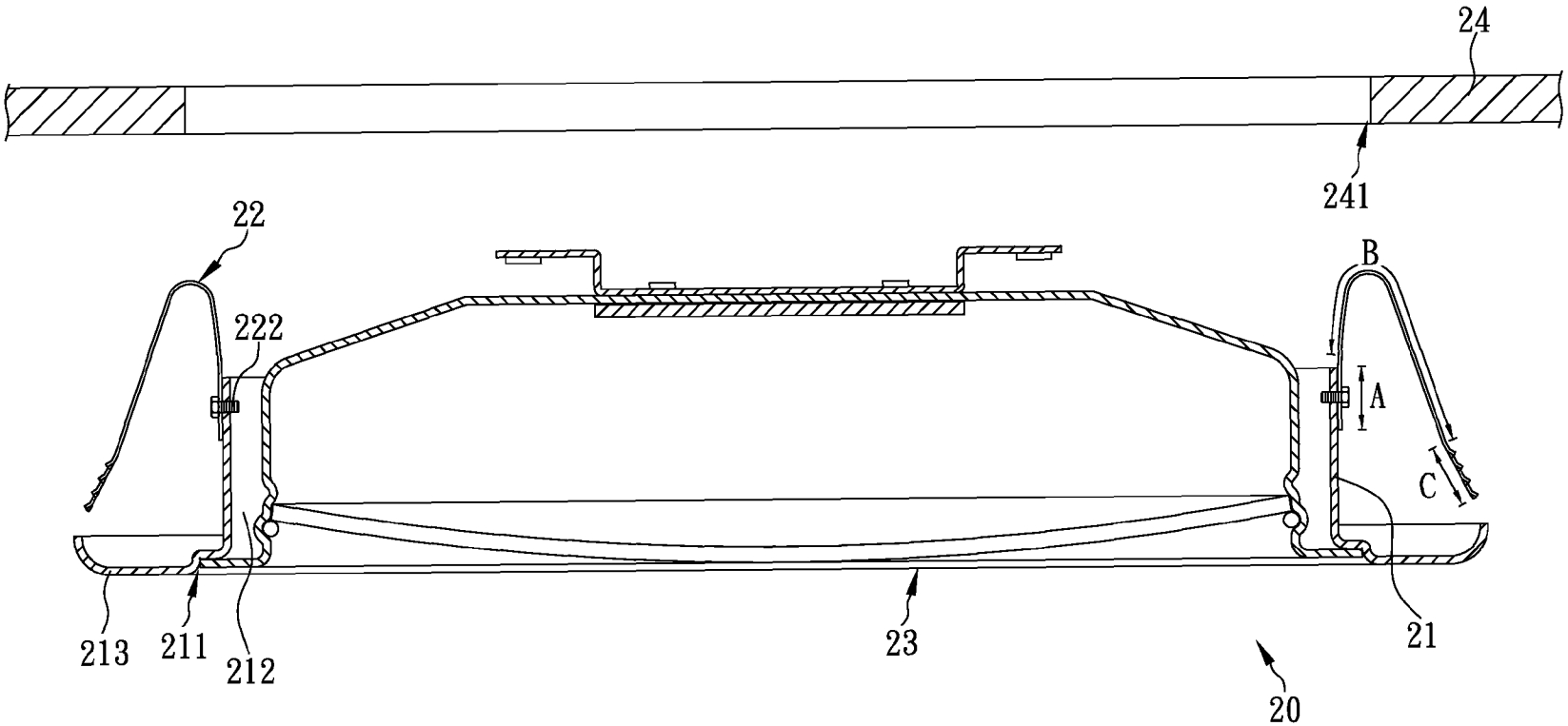
FIG. 3 is a sectional view of a first preferred embodiment of the present invention.
Figure 4:
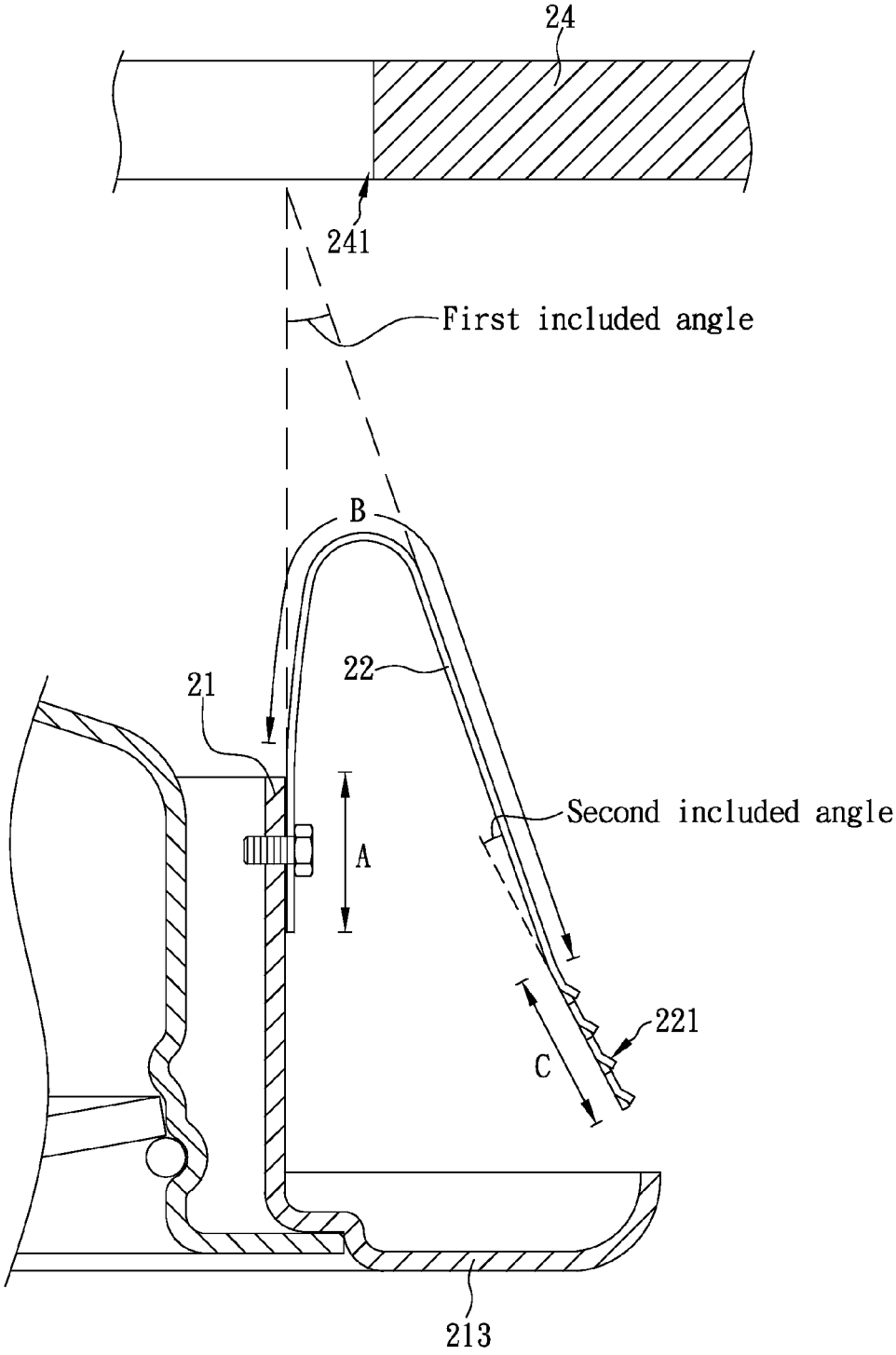
FIG. 4 is a partial enlarged view of the first preferred embodiment of the present invention.

Referring to FIGS. 3 and 4, a recessed lamp support structure 20 according to a first preferred embodiment of the present invention includes a lamp holder 21 and at least two resilient plates 22. The lamp holder 21 has a bottom portion formed with an opening 211. In addition, the lamp holder 21 is provided therein with a receiving space 212 for accommodating a light-emitting element 23. The light-emitting element 23 can be an LED light bulb, an incandescent light bulb, a fluorescent light bulb, or light bulbs of other kinds. The lamp holder 21 has a peripheral edge which is adjacent to the opening 211 and extends radially so as to form an annular frame 213 around the bottom portion of the lamp holder 21. Each resilient plate 22 is formed with a front section (A), a middle section (B), and a rear section (C) by bending a flexible metal plate. The front sections of the resilient plates 22 are fixedly connected to a sidewall of the lamp holder 21 in a symmetrical manner. In the present embodiment, the front sections of the resilient plates 22 are fixedly connected to the sidewall of the lamp holder 21 by screws 222. In a different embodiment of the present invention, however, the front sections of the resilient plates 22 can be fixedly connected to the sidewall of the lamp holder 21 by riveting, bonding, or soldering, instead of screwing. The middle section of each resilient plate 22 extends toward the rim of the annular frame 213 and has a tail end from which the corresponding rear section extends. The tail end of each middle section has a tangent line that forms a first included angle with the sidewall of the lamp holder 21. The first included angle in the present embodiment is 19 degrees. Moreover, the rear section of each resilient plate 22 and the tangent line of the tail end of the corresponding middle section jointly form a second included angle, which is 8 degrees in the present embodiment.

Figure 5:
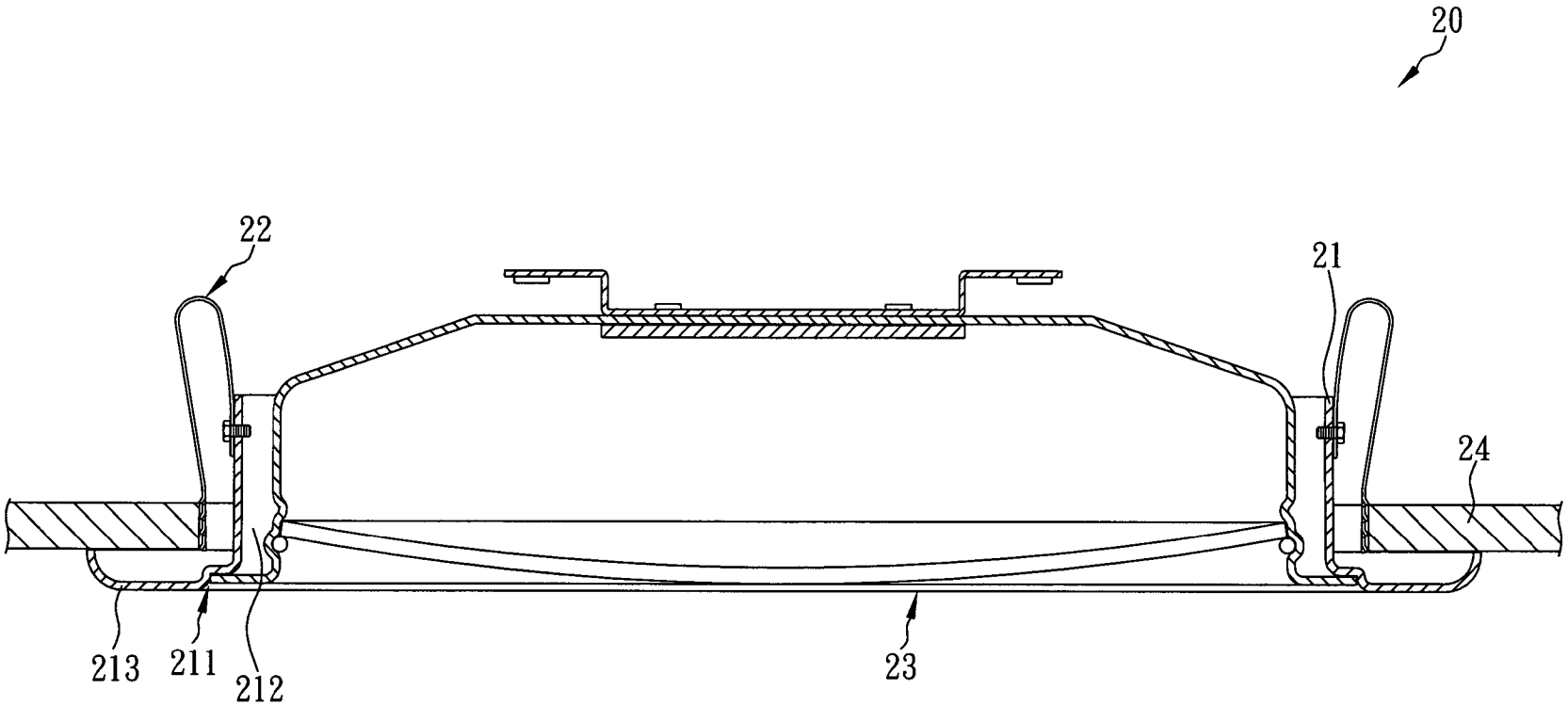
FIG. 5 is another sectional view of the first preferred embodiment of the present invention.

Referring to FIGS. 4 and 5, in the first preferred embodiment of the present invention, the magnitude of each first included angle and the length of the middle section of each resilient plate 22 not only allow the sidewall of the lamp holder 21 to pass through a receiving hole 241 cut into a ceiling 24 and be received on a top side of the ceiling 24, but also allow the rear sections of the resilient plates 22 to press tightly against the inner periphery of the receiving hole 241 while a top side of the annular frame 213 presses against a bottom side of the ceiling 24. In other words, the magnitude of each first included angle and the length of the middle section of each resilient plate 22 must match the thickness of the ceiling 24 and the size of the receiving hole 241. If the first included angles are too large or if the middle section of each resilient plate 22 is too long, the middle sections of the resilient plates 22 will obstruct the lamp holder 21 from entering the receiving hole 241. However, if the first included angles are too small or if the middle section of each resilient plate 22 is too short, the gap between the receiving hole 241 and the sidewall of the lamp holder 21 may be so wide as to result in accumulation of dust. Besides, the rear section of each resilient plate 22 has an outer surface formed as a roughened surface 221. While the roughened surfaces 221 in the present embodiment have an undulated configuration, the roughened surfaces 211 in a different embodiment of the present invention may instead have a serrated configuration, a granular configuration, or other regular or irregular configurations. Furthermore, if sufficient elastic stress is built up in the resilient plates 22, the outer surfaces of the rear sections of the resilient plates 22 need not be formed as the roughened surfaces 211 and yet are still capable of pressing tightly against the inner periphery of the receiving hole 241. Therefore, the roughened surfaces 221 are not an essential feature of the present embodiment.

Additionally, referring again to FIGS. 4 and 5, the magnitude of each second included angle and the length of the rear section of each resilient plate 22 allow the outer surfaces of the rear sections of the resilient plates 22 to press evenly and tightly against the inner periphery of the receiving hole 241, thereby generating a friction between the roughened surfaces 221 and the inner periphery of the receiving hole 241. The friction can sustain the weight of the recessed lamp support structure 20 and thus positions the recessed lamp support structure 20 securely in the receiving hole 241. In other words, the magnitude of each second included angle and the length of the rear section of each resilient plate 22 must also match the thickness of the ceiling 24 and the size of the receiving hole 241. If the second included angles are too large or too small, or if the rear section of each resilient plate 22 is too short, there will be insufficient area of contact between the roughened surfaces 221 of the rear sections of the resilient plates 22 and the inner periphery of the receiving hole 241. As a result, the friction between the roughened surfaces 221 and the inner periphery of the receiving hole 241 will be insufficient to hold the weight of the recessed lamp support structure 20, and the recessed lamp support structure 20 is likely to fall out of the receiving hole 241.

As shown in FIGS. 3 and 5, when it is desired to install the recessed lamp support structure 20 in the receiving hole 241, a user can press the rear sections of the resilient plates 22 provided on the lamp holder 21 and thus overcome the resilient force of the resilient plates 22, such that the rear and front sections of each resilient plate 22 become close to each other. Then, a top portion of the lamp holder 21 is inserted into the receiving hole 241 of the ceiling 24, and the pressing on the resilient plates 22 is released. Owing to the stress of the resilient plates 22, the roughened surfaces 221 formed on the rear sections of the resilient plates 22 will move away from the sidewall of the lamp holder 21 and press tightly against the inner periphery of the receiving hole 241, thereby generating a horizontal tension between the inner periphery of the receiving hole 241 and the sidewall of the lamp holder 21. Consequently, the recessed lamp support structure 20 is securely positioned in the receiving hole 241 by friction between the roughened surfaces 221 and the inner periphery of the receiving hole 241 while the annular frame 213 covers the gap between the receiving hole 241 and the sidewall of the lamp holder 21. By means of only a plurality of bent resilient plates 22 connected to the sidewall of the lamp holder 21 and no other fastening elements (e.g., screws or engaging elements), the present invention allows the user to install the recessed lamp support structure 20 in the receiving hole 241 of the ceiling 24 or remove the recessed lamp support structure 20 therefrom in a rapid and convenient way. Hence, the recessed lamp support structure 20 of the present invention, which is capable of fast and safe installation and removal, overcomes the inconvenience of installation and removal of the conventional recessed lamp structures.

In the present embodiment, the annular frame 213 formed around the bottom portion of the lamp holder 21 has a circular configuration. However, in other embodiments of the present invention, the annular frame 213 may be rectangular, have a wavy perimeter, or take on other annular configurations. The annular frame 213 of the present invention may have any configuration provided that the annular frame 213 is formed around the bottom portion of the lamp holder 21 and can cover the gap between the receiving hole 241 and the sidewall of the lamp holder 21.

Figure 6:
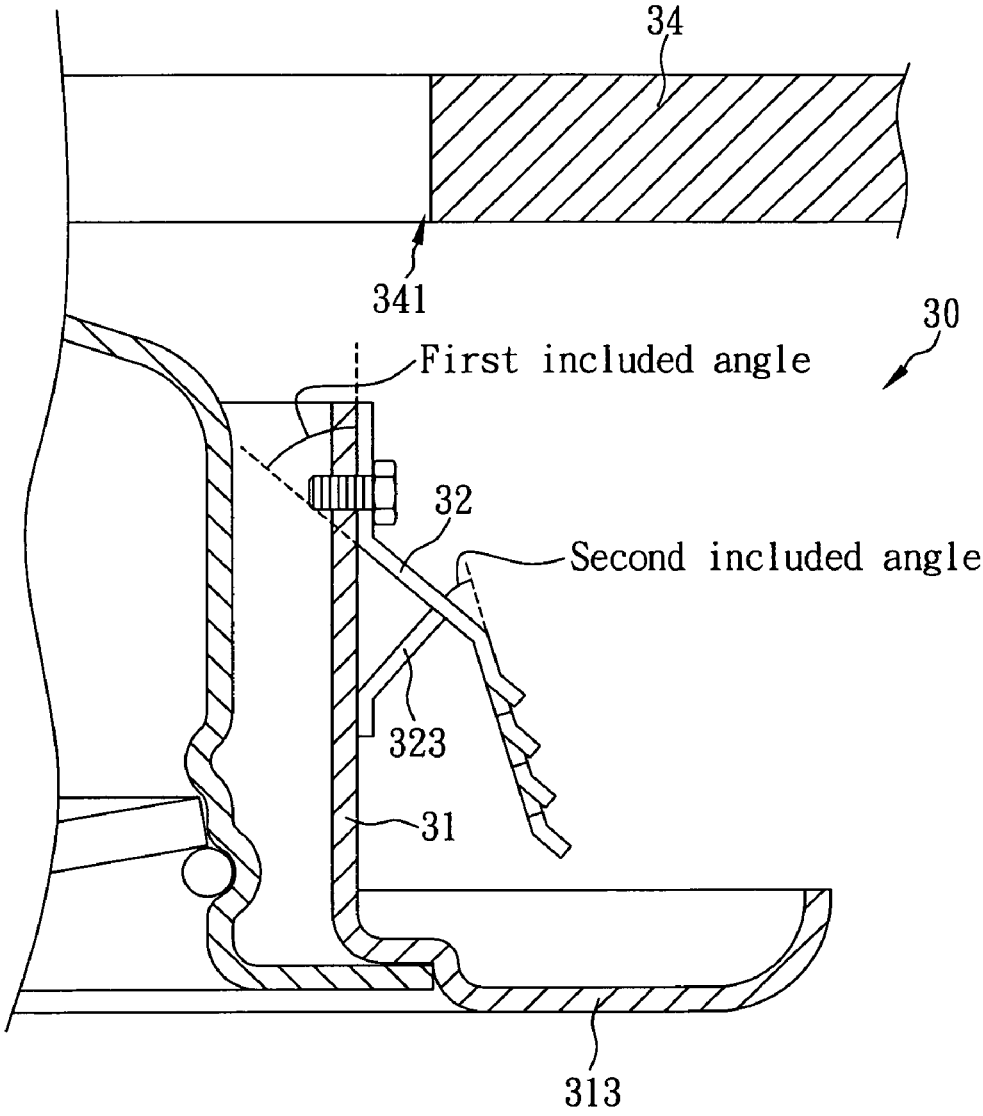
FIG. 6 is a partial enlarged view of a second preferred embodiment of the present invention.

Please refer to FIG. 6 for a recessed lamp support structure 30 according to a second preferred embodiment of the present invention. As shown in the drawing, a resilient plate 32 is made by bending a flexible metal plate so as to form a front section, a middle section, and a rear section. The front section is fixedly connected to a sidewall of a lamp holder 31. The middle section of the resilient plate 32 extends toward the rim of an annular frame 313 and has a tail end from which the rear section of the resilient plate 32 extends. A tangent line of the tail end of the middle section forms a first included angle with the sidewall of the lamp holder 31. The rear section of the resilient plate 32 forms a second included angle with the tangent line of the tail end of the middle section. In addition, the middle section of the resilient plate 32 is further provided with a second plate 323. The second plate 323 is integrally formed with the resilient plate 32 by stamping and extends toward the sidewall of the lamp holder 31. When a user presses the rear section of each of a plurality of resilient plates 32 connected to the lamp holder 31, the front and rear sections of each resilient plate 32 are brought close to each other. At the same time, each second plate 323 has one end pressed against and sliding along the sidewall of the lamp holder 31. During this process, the second plates 323 are stressed and therefore exert a reaction force on the resilient plates 32. When a top portion of the lamp holder 31 is subsequently inserted into a receiving hole 341 of a ceiling 34, and the pressing on the resilient plates 32 is released, a stronger horizontal tension than in the first preferred embodiment is created between the sidewall of the lamp holder 31 and the inner periphery of the receiving hole 341 as a result of not only the stress of the resilient plates 32 but also the reaction force transmitted by the second plates 323. Thus, the outer surfaces of the rear sections of the resilient plates 32 press more securely and more tightly against the inner periphery of the receiving hole 341, and in consequence the recessed lamp support structure 30 is more securely installed in the receiving hole 341 of the ceiling 34.

Figure 7:
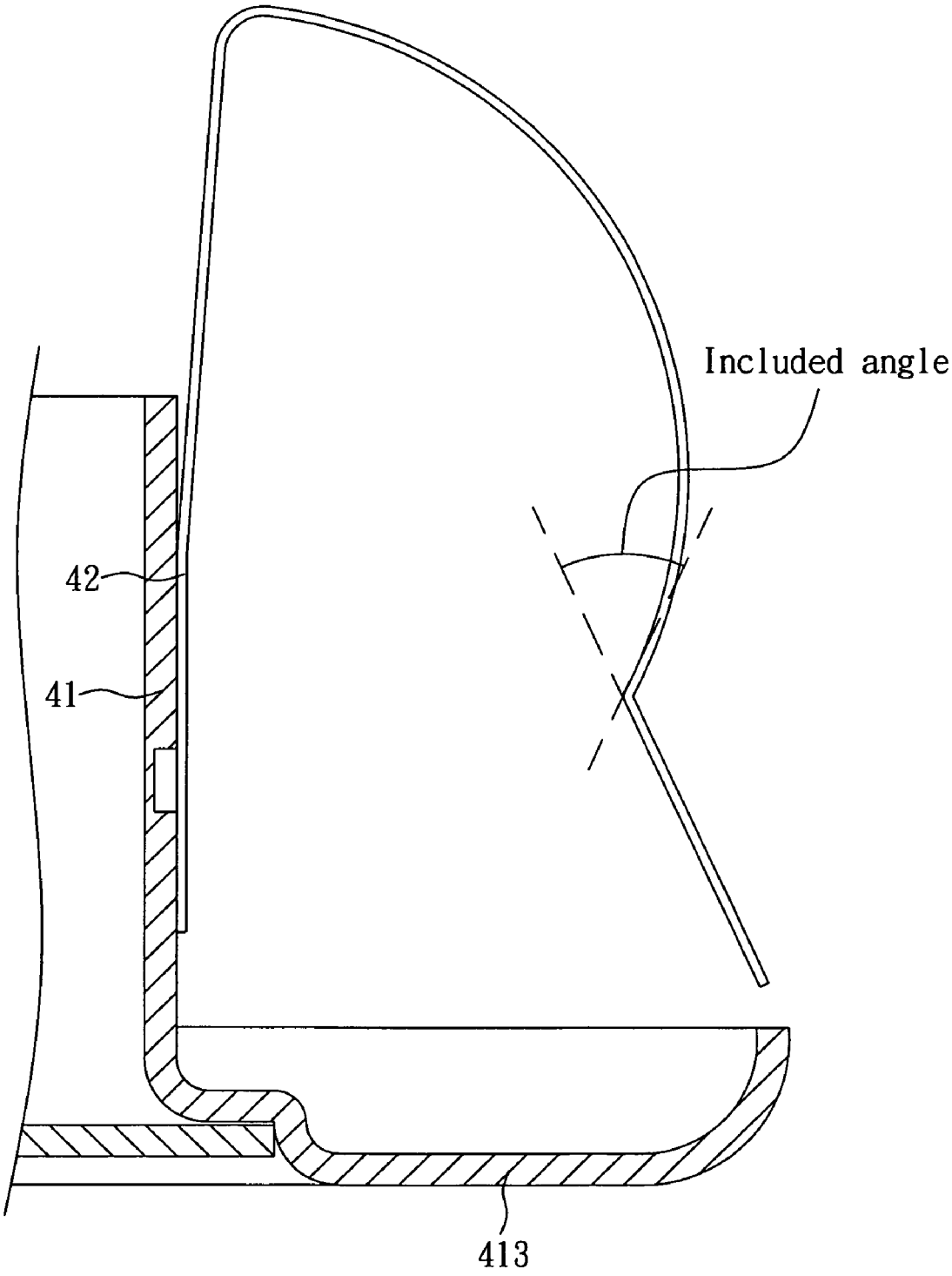
FIG. 7 is a partial enlarged view of a third preferred embodiment of the present invention.
Figure 8:
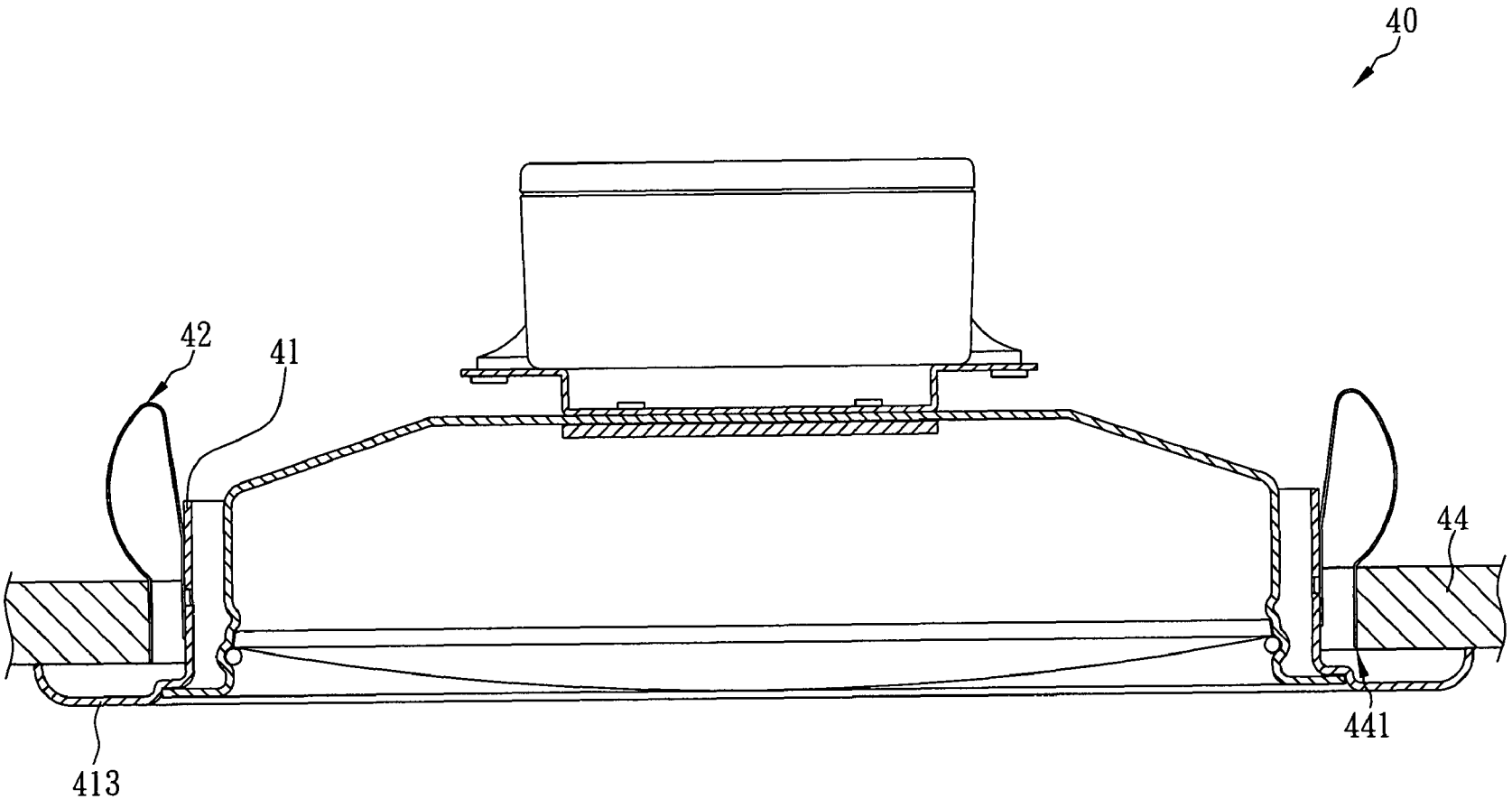
FIG. 8 is sectional view of the third preferred embodiment of the present invention.

Please refer to FIGS. 7 and 8 for a recessed lamp support structure 40 according to a third preferred embodiment of the present invention. As shown in FIG. 7, a resilient plate 42 is formed with a front section, a middle section, and a rear section by bending a flexible metal plate. The front section of the resilient plate 42 is fixedly connected to a sidewall of a lamp holder 41 by riveting. The middle section of the resilient plate 42 extends toward the rim of an annular frame 413 and has a tail end from which the rear section of the resilient plate 42 extends. The rear section of the resilient plate 42 forms an included angle with a tangent line of the tail end of the middle section, wherein the included angle is 50 degrees in the present embodiment. As shown in FIGS. 7 and 8, a user can press the rear section of each of a plurality of resilient plates 42 connected to the lamp holder 41 such that the front and rear sections of each resilient plate 42 are close to each other. At the meantime, a top portion of the lamp holder 41 is inserted into a receiving hole 441 of a ceiling 44. As soon as the pressing on the resilient plates 42 is released, the outer surfaces of the rear sections of the resilient plates 42 move away from the sidewall of the lamp holder 41 and press tightly against the inner periphery of the receiving hole 441 due to the stress of the resilient plates 42. Thus, the recessed lamp support structure 40 is securely positioned in the receiving hole 441 by friction between the outer surfaces of the rear sections of the resilient plates 42 and the inner periphery of the receiving hole 441 while the annular frame 413 covers the gap between the receiving hole 441 and the sidewall of the lamp holder 41.

The terminology and description of the foregoing embodiments (e.g., the magnitudes of the first and second included angles, the configurations of the resilient plates, and the configuration of the roughened surfaces) only serve to demonstrate the preferred embodiments of the present invention and should not be construed as limitative of the scope of the present invention, which is defined only by the appended claims. A person of skill in the art who has reviewed the technical contents disclosed herein may easily conceive variations, structural modifications, or equivalent changes made possible by structures or devices other than those described above. Therefore, all such variations, modifications, and equivalent changes should be encompassed by the claims.

What is claimed is:

1. A recessed lamp support structure, comprising:

a lamp holder having a bottom portion formed with an opening, the lamp holder defining therein a receiving space for accommodating and fixing a light-emitting element therein, the lamp holder having a peripheral edge which is adjacent to the opening and extends radially so as to form an annular frame around the bottom portion of the lamp holder; and at least two resilient plates, each said resilient plate made by bending a flexible metal plate so as to form a front section, a middle section, and a rear section, the front sections of the at least two resilient plates being fixedly connected to a sidewall of the lamp holder in a symmetrical manner, the middle section of each said resilient plate extending toward a rim of the annular frame and having a tail end from which a corresponding said rear section extends, wherein a length of the middle section of each said resilient plate allows the sidewall of the lamp holder to pass through a receiving hole formed in a ceiling and be received on a top side of the ceiling such that the rear section of each said resilient plate presses tightly against an inner periphery of the receiving hole while a top side of the annular frame presses against a bottom side of the ceiling, tangent lines of each said resilient plate and the tail end of a corresponding said middle section form an included angle, and the magnitude of each said included angle and a length of the rear section of each said resilient plate allow an outer surface of the rear section of each said resilient plate to press against the inner periphery of the receiving hole.

2. The recessed lamp support structure of claim 1, wherein the outer surface of the rear section of each said resilient plate is formed as a roughened surface.

3. The recessed lamp support structure of claim 1, wherein each said resilient plate is provided with a second plate, and each said second plate is integrally formed with a corresponding said resilient plate by stamping and extends toward the sidewall of the lamp holder.

4. The recessed lamp support structure of claim 2, wherein each said resilient plate is provided with a second plate, and each said second plate is integrally formed with a corresponding said resilient plate by stamping and extends toward the sidewall of the lamp holder.

5. The recessed lamp support structure of claim 3, wherein the tangent line of the tail end of each said middle section and the sidewall of the lamp holder form another included angle.

6. The recessed lamp support structure of claim 4, wherein the tangent line of the tail end of each said middle section and the sidewall of the lamp holder form another included angle.

* * * * *